United States Patent [19]

Mifune

[11] Patent Number: 4,914,017

[45] **Date of Patent: * Apr. 3, 1990**

[54] GOLD SENSITIZED SILVER HALIDE EMULSION AND PHOTOGRAPHIC SILVER HALIDE LIGHT-SENSITIVE MATERIAL USING SAME

[75] Inventor: Hiroyuki Mifune, Kanagawa, Japan

[73] Assignee: Fuji Photo Film Co., Ltd., Kanagawa, Japan

[ * ] Notice: The portion of the term of this patent subsequent to Jul. 4, 2006 has been disclaimed.

[21] Appl. No.: 62,642

[22] Filed: Jun. 16, 1987

[51] Int. Cl.[4] ..... G03C 1/06

[52] U.S. Cl. ..... 430/604; 430/605

[58] Field of Search ..... 430/604, 605

[56] References Cited

U.S. PATENT DOCUMENTS

| | | | |
|---|---|---|---|
| 3,782,953 | 1/1974 | Maley | 430/569 |
| 3,782,960 | 1/1974 | Walters et al. | 430/605 |
| 3,881,934 | 5/1975 | Claes | 430/642 |
| 4,581,328 | 4/1986 | Matsuyama | 430/605 |
| 4,639,416 | 1/1987 | Yoshida et al. | 430/603 |

*Primary Examiner*—Roland E. Martin
*Assistant Examiner*—Patrick A. Doody
*Attorney, Agent, or Firm*—Sughrue, Mion, Zinn, Macpeak & Seas

[57] ABSTRACT

A gold-sensitized silver halide emulsion of surface latent image type exhibits improved shelf stability while maintaining high sensitivity when at least 80% of the gold sensitizer is contained in the silver halide grain phase. A photographic silver halide light-sensitive material is prepared as comprising at least one emulsion layer which contains the improved silver halide emulsion.

15 Claims, No Drawings

GOLD SENSITIZED SILVER HALIDE EMULSION AND PHOTOGRAPHIC SILVER HALIDE LIGHT-SENSITIVE MATERIAL USING SAME

BACKGROUND OF THE INVENTION

This invention relates to a silver halide emulsion and a photographic silver halide light-sensitive material using the same. More particularly, it relates to a novel and improved photographic silver halide light-sensitive material having improved shelf stability and high sensitivity.

In general, silver halides used in photographic silver halide light-sensitive materials are chemically sensitized in order to obtain the desired sensitivity and gradation. Many sensitizing methods are known in the art, including sulfur sensitization using sulfur-containing compounds or active gelatin capable of reacting with silver ions, reduction sensitization using reducing materials, and noble metal sensitization using gold and similar noble metals. These methods may be used alone or in combination. Sulfur sensitizers include thiosulfates, thioureas, thiazoles, rhodanines and other compounds, with illustrative examples being described in U.S. Pat. Nos. 1,574,944; 2,410,689; 2,278,947; 2,728,668; 3,656,955; 4,030,928; and 4,067,740. Reducing sensitizers include stannous salts, amine salts, hydrazine derivatives, formamidine sulfinic acid, silane compounds and other compounds, with illustrative examples being described in U.S. Pat. Nos. 2,487,850; 2,419,974; 2,518,698; 2,983,609; 2,983,610; 2,694,637; 3,930,867; and 4,054,458. For noble metal sensitization, complex salts of metals belonging to Group VIII of the Periodic Table, such as platinum, iridium, and palladium may be used. Illustrative examples are described in U.S. Pat. Nos. 2,399,083 and 2,448,060; and British Patent No. 618,061.

There is an increasing need for silver halide emulsions with higher sensitivity. For such a purpose, it is essential to use more than one of the above-described chemical sensitization methods in combination, most often a combined method using sulfur and noble metal sensitizers, especially a combined gold-sulfur sensitization method using sulfur and gold sensitizers.

In such combined sensitization, the amounts of the sensitizers used depend on the state of silver halide grains (such as grain size and its distribution, halogen composition, and crystal habit), the environmental parameters (such as the amount and type of binder, pH, pAg, reaction temperature, and reaction time), and auxiliary agents for gold sensitization (such as promoters, typically thiocyanates and thioether compounds, and antifoggants, typically thiosulfonates) as well as the type of particular sulfur and gold sensitizers used. Determination of sensitizer amounts and the procedure of carrying out combined sensitization are well known to those skilled in the art.

These chemical sensitizers, when added to a silver halide emulsion, do not have reacted to the entirety of their amounts added, and part of them remains unreacted in the silver halide emulsion. Such a silver halide emulsion often undergoes a change during preparation or storage of a light-sensitive material, incurring a change with time in the photographic properties. This adverse effect is considered due to the presence of residual chemical sensitizers in the binder phase of the silver halide emulsion. Particularly the gold sensitizer which remains in the binder phase in a substantial amount is liable to migrate into the silver halide grain phase through diffusion or the like with time during the period from chemical sensitization to application to a support, or even after the application, incurring an undesirable change with time in photographic properties including sensitivity, gradation and fog.

To suppress such a phenomenon, efforts have been made to reduce the amount of gold sensitizer left in the binder phase by changing the chemical sensitizing conditions or using a palladium complex salt in combination. These methods are still insufficient. The prior art technique has the limit that the maximum amount of gold which can be contained in the silver halide phase is about 70% of the entire amount of gold added as demonstrated in the Example given later wherein the amounts of gold contained in the silver halide and binder (gelatin) phases are measured.

The adverse effect of remaining chemical sensitizers on photographic properties as mentioned above is outstanding when the silver halide emulsion used is of surface latent image type. There is a need for improving the age stability of a silver halide emulsion of surface latent image type by minimizing the amount of gold sensitizer remaining in the binder phase.

SUMMARY OF THE INVENTION

A primary object of the present invention is to provide an improved gold-sensitized silver halide emulsion substantially of surface latent image type which exhibits excellent age stability and high sensitivity.

Another object of the invention is to provide a photographic silver halide light-sensitive material using the improved silver halide emulsion.

According to a first aspect of the present invention, there is provided a gold-sensitized silver halide emulsion substantially of surface latent image type comprising silver halide grains and a gold sensitizer, at least 80% of the gold sensitizer being present in the silver halide grain phase.

According to a second aspect of the present invention, there is provided a photographic silver halide light-sensitive material comprising at least one emulsion layer which contains at least one gold-sensitized silver halide emulsion substantially of surface latent image type comprising silver halide grains and a gold sensitizer, at least 80% of the gold sensitizer being present in the silver halide grain phase.

According to a third aspect of the present invention, there is provided a photographic silver halide light-sensitive material comprising at least one layer of a gold-sensitized silver halide emulsion substantially of surface latent image type, at least 80% of the total amount of gold sensitizer contained in said light-sensitive material being present in the silver halide grain phase.

It is to be noted that all percents are by weight throughout the specification and claims unless otherwise stated.

DETAILED DESCRIPTION OF THE INVENTION

The silver halide emulsion of the present invention is a gold-sensitized silver halide emulsion substantially of surface latent image type comprising silver halide grains and a gold sensitizer. Essentially the silver halide emulsion consists of silver halide grain and binder phases. At least 80%, preferably at least 85%, more preferably at least 90%, and most preferably at least 93% of the gold sensitizer is present in the silver halide grain phase.

The photographic silver halide light-sensitive material of the present invention has at least one emulsion layer which contains at least one silver halide emulsion as defined above.

The present invention offers favorable results by minimizing the proportion of the gold sensitizer remaining in the binder phase of the silver halide emulsion. This also enables to make more effective stabilizers or antifoggants as typified by 4-hydroxy-6-methyl-1,3,3a,7-tetrazaindene, 1-phenyl-5-mercaptotetrazole and their derivatives.

In general, a silver halide emulsion is prepared by a process involving the steps of mixing alkali halide and silver nitrate in the presence of gelatin to form silver halide grains by any of well-known techniques as will be described later, physical ripening, cooling, washing, heating, chemical sensitizing, and again cooling for solidification. More specifically of chemical sensitization, the initially formed silver halide emulsion is desalted, washed with water, dispersed in fresh gelatin, and adjusted for pH and pAg before it is subject to chemical sensitization by introducing a chemical sensitizer, typically a gold sensitizer preferably in admixture with a sulfur sensitizer. The chemically sensitized emulsion is combined with various additives and then applied to a support. The present invention is accomplished by removing the majority of the gold sensitizer initially introduced remaining in the binder phase of the chemically sensitized emulsion during or after chemical sensitization by a method as will be described below. The time when an excess of gold sensitizer is removed includes both during and after chemical sensitization, more precisely a period of chemical sensitization process between the addition of a chemical sensitizer and the start of cooling from the chemical ripening temperature and a subsequent period from the start of cooling.

Illustrative, but non-limiting examples of the method for reducing the amount of gold sensitizer remaining in the binder phase are given below. Some of the methods described in Research Disclosure, December 1978, Item 17643, IIA may be used by modifying them so as to comply with the present objectives, that is, to remove the gold sensitizer remaining in the gelatin phase such that the gold in the silver halide grain phase comprises at least 80% of the entire gold.

(a) Adsorption

The gold-sensitized emulsion is treated with a porous adsorbent or ion-exchange resin to adsorb and remove that portion of the gold sensitizer remaining in the binder phase before the emulsion is applied to a support. The porous adsorbents used herein are porous solid adsorbents having an increased surface area, examples of which are inorganic porous adsorbents including active carbon, active alumina; activated clay, silica adsorbents (preferably water-resistant); zeolite adsorbents, porous glass, and porous ceramics. The most preferred adsorbent is active carbon.

Some illustrative non-limiting examples of the ion-exchange resins used herein include cation exchange resins such as Amberite IR-120 (trade name, manufactured by Rohm & Haas); anion exchange resins such as Diaion SA-21A (trade name, manufactured by Dow Chemicals); amphoteric resins; and chelate resins such as Diaion CR-20 (trade name, manufactured by Mitsubishi Chemicals K.K.). A variety of these ion-exchange resins are marketed and any particular one best suited for the purpose will be readily available. Preferred among them are the anion exchange resins, amphoteric resins and chelate resins, with the anion exchange resins being most preferred.

The practical use of these adsorbents and ion-exchange resins is set forth in copending commonly assigned U.S. patent application Ser. No. 844,494 by Mifune.

It will be understood that removal by adsorption may be carried out both during and after gold sensitization.

(b) Washing

The gold-sensitized emulsion is washed with water before it is applied to a support. The water washing technique may be either flocculation or noodle technique well known in the art. Washing is preferably carried out at a temperature of up to 30° C., especially 5° to 25° C. for 5 to 60 minutes, especially 10 to 30 minutes. The wash liquid used may be water or aqueous solutions of alkali halides, thiocyanates and sulfites. The conventional noodle washing requires gelation of gelatin, and the flocculation technique uses inorganic salts of a polyvalent anion such as sodium sulfate, anionic surface-active agents, anionic polymers (e.g. polystyrene sulfonate), and gelatin derivatives (e.g. aliphatic acylated gelatin, aromatic acylated gelatin, aromatic carbamoylated gelatin).

Removal by washing is applicable only after gold sensitization.

(c) Mechanical separation

The gold-sensitized emulsion is subjected to mechanical separation, typically centrifugal separation and liquid cyclone separation to remove a necessary amount of the binder phase in which the gold sensitizer remains. An equal amount of a fresh binder is then added. For centrifugal and liquid cyclone separation, reference is made to U.S. Pat. No. 3,881,934 and British Patent No. 1,336,692.

Mechanical separation is applicable only after gold sensitization.

These methods may be used alone or in combination.

The partition coefficient of the gold sensitizer between the silver halide grain phase and the binder phase may be measured by the method described below.

It will be understood that the quantitative determination of the gold sensitizer present in the silver halide grain phase or the binder phase may be carried out by such analysis as colorimetry, atomic absorption spectroscopy, ICP emission spectral analysis, neutron activation analysis, and mass spectroscopy.

More illustratively, analysis may be made by performing procedures (i), (ii) or (iii) given below.

(i) The silver halide emulsion dispersion before application to a support is centrifugally separated into the silver halide grain solid phase and the binder phase. The amounts of gold sensitizer in the respective phases are quantitatively determined by any desired analysis method.

(ii) The silver halide emulsion in the form of a coating applied to a support is swelled with water and subjected to enzyme or acid degradation to thereby separated the silver halide emulsion from the support. The emulsion is then centrifugally separated into the silver halide grain solid phase and the binder phase. The amounts of gold sensitizer in the respective phases are quantitatively determined by any desired analysis method.

(iii) It is known that when the silver halide emulsion in the form of a coating applied to a support is carefully washed with a dilute aqueous solution of sodium thiosulfate (for example, 0.01% emulsion) such that the silver halide may not be fixed, substantially the entirety of the gold sensitizer is washed away from the binder phase. The amounts of gold sensitizer in the silver halide grain solid phase and the binder phase are obtained by quantitatively determining the total amount of the gold sensitizer in the coating both before and after washing with the sodium thiosulfate bath. With respect to procedure (iii), reference is made to P. A. Falens, "Photographische Korrepondenz", Vol. 104 (1968), pages 137–146.

It is preferred to determine the partition coefficient by procedure (iii) or (i).

Gold sensitization uses a gold sensitizer, preferably gold complex salts as disclosed in U.S. Pat. No. 2,399,083. Some preferred examples are chloroauric acid, potassium chloroaurate, potassium aurithiocyanate, auric trichloride, sodium aurithiosulfate, and auric 5-sulfobenzothiazole-2-sulfide chloride. The amount of the gold sensitizer contained in the silver halide grain phase preferably ranges from about $10^{-9}$ to $10^{-3}$ mol, especially from about $10^{-8}$ to $10^{-4}$ mol per mol of silver halide.

In the practice of the present invention, gold sensitization is preferably combined with sulfur sensitization. The sulfur sensitizers used herein include thiosulfates, thiourea, thiazoles, rhodanines, and other sulfur compounds, for example, those described in U.S. Pat. Nos. 1,574,944, 2,410,689, 2,278,947, 2,728,668, 3,656,955, 4,030,928, and 4,067,740, with the thiosulfates, thiourea, and rhodanines being most preferred. Other chemical sensitizations including sulfur sensitization may preferably be carried out at the same time as gold sensitization.

The silver halide grains contained in at least one silver halide emulsion layer in the practice of the present invention is substantially of surface latent image type. The term "substantially of surface latent image type" used herein means that when a light-sensitive material having such an emulsion coated thereon is exposed to light for 1 to 1/100 second and then developed by a surface development process (A) and an internal development process (B) as defined below, the sensitivity of the material available with surface development (A) is higher than that available with internal development (B). The sensitivity is defined by the equation:

$$S=100/Eh$$

wherein S is sensitivity, and Eh is an exposure required to obtain an intermediate density (Dmax+Dmin)/2 between the maximum density (Dmax) and the minimum density (Dmin).

SURFACE DEVELOPMENT (A)

The light-sensitive material is developed in a developer of the following formulation at a temperature of 20° C. for 3 minutes.

| | |
|---|---|
| p-hydroxyphenylglycine | 24 grams |
| Sodium carbonate monohydrate | 60.8 grams |
| Sodium chloride | 2.8 grams |
| Water | totaling to 1 liter |

INTERNAL DEVELOPMENT (B)

The light-sensitive material is treated in a bleaching solution containing 3 grams of potassium ferricyanide and 0.0125 grams of phenosafranine per liter of the solution at about 20° C. for 10 minutes, washed with water for 10 minutes, and then developed in a developer of the following formulation at 20° C. for 10 minutes.

| | |
|---|---|
| N-methyl-p-aminophenol hemisulfate | 5 grams |
| Hydroquinone | 10 grams |
| Sodium sulfite anhydride | 75 grams |
| Sodium metaborate tetrahydrate | 30 grams |
| Caustic soda | 10 grams |
| Sodium thiosulfate | 3 grams |
| Water | totaling to 1 liter |

The emulsions of the present invention may be used alone or in combination of two or more to form a silver halide emulsion layer. For example, a combination of emulsions which are different in halogen composition, grain size, and the type and amount of gold sensitizer may be used. It is also possible to combine the emulsion of the present invention with another emulsion to such an extent that the advantages of the present invention are not lost.

The emulsion layer in the photographic silver halide light-sensitive material may be a single layer or multiple layers, for example, two or three layers. Each layer may contain the emulsion of the present invention alone or in admixture of two or more. These layers may be different in grain size and halogen composition.

The photographic silver halide light-sensitive material may comprise an emulsion layer having at least three layers having different color sensitivities, for example, blue-, red-, and green-sensitive layers.

In the case of a light-sensitive material having more than one emulsion incorporated, it suffices that at least one emulsion of the present invention is used. More preferably, the light-sensitive material is designed such that at least 80% of the entire gold sensitizer(s) is present in the silver halide grain phase of the material. Most preferably, all the emulsions used fall within the scope of the present invention.

The photographic emulsion of the present invention may contain any desired silver halide including silver bromide, silver iodobromide, silver iodochlorobromide, silver chlorobromide, silver iodide, and silver chloride.

The silver halide may have either a broad or narrow grain size distribution.

Examples of the silver halide grains in the photographic emulsions include grains having a regular crystal form such as cube, octahedron, tetradecahedron, and rhombic dodecahedron, an irregular crystal form such as sphere and plate, or a composite form of these crystal forms, or a mixture of different crystal form grains. Plate grains may also be used which have a diameter at least three times, preferably 5 to 20 times greater than its thickness, provided that the diameter of a grain is the diameter of a circle having an area equal to the projected area of the grain and the thickness is the distance between two approximately parallel major surfaces. One preferred emulsion contains plate grains in an amount occupying at least 50% of the total projected area of grains. In this respect, reference is made to U.S. Pat. Nos. 4,434,226 and 4,439,520, European Patent No. 84,637A2, Gutoff, Photographic Science and Engineering, Vol. 14 (1970), pages 248–257, and Research Disclosure, Vol. 225, No. 22534 (January 1983), pages 20–58.

Also employable is a mono-dispersed emulsion comprising hexagonal plate grains as disclosed in Japanese patent application No. 61-299155. This emulsion is a silver halide emulsion comprising a dispersant and silver halide grains wherein at least 70% of the total projected area of the grains comprises hexagonal plate silver halide grains of a hexagonal shape having a ratio in length of the side having the maximum distance to the side having the minimum distance of at most 2 and having two parallel outer surfaces. The emulsion is mono-dispersed such that the hexagonal plate silver halide grains possess a grain size distribution having a coefficient of variation of up to 20%, said coefficient of variation being the variation of grain size as expressed in the diameter of an equivalent circle to the projected area (standard of deviation) divided by the mean grain size. The grains have an aspect ratio of at least 2.5 and a size of at least 0.2 μm. Such silver halide grains may be produced by a process involving nucleation, Ostwald ripening, and grain growth according to the teaching of Japanese patent application No. 61-299155.

The silver halide grains may have a homogeneous phase throughout the grain or be comprised of a core and a shell of different phases.

Further examples of the silver halide grains include junction type silver halide crystals having silver halide crystals (such as silver chloride crystals) bonded to oxide crystals (such as PbO), epitaxially grown silver halide crystals (such as silver bromide having silver chloride, silver iodobromide, silver iodide or the like epitaxially grown thereon), and crystals of hexagonal silver iodide having regular hexahedral silver chloride orientatedly overgrown.

The silver halide grains in the photographic emulsions may have any desired grain size distribution or of a mono-dispersion system. By the term monodispersion is meant a dispersion system wherein 95% of the grains fall within a range of ±60% of the number average grain size, preferably within a range of ±40% of the number average grain size, provided that the number average grain size is a number average diameter calculated from projected area equivalent circle diameters of silver halide grains.

In the practice of the present invention, the photographic emulsions may be prepared by any well-known conventional processes as disclosed in Research Disclosure, Item 17643, I and II, pages 22–23 (December 1978) and the literature cited therein. They may be prepared by any of acidic, neutral, and ammoniacal methods. The reaction of a soluble silver salt with a soluble halide salt may be effected by any of the well-known conventional methods including a single jet method, a double jet method, and a combination thereof. Also employable is a method of forming silver halide grains in the presence of excess silver ions, which method is also known as back mixing method. One useful double jet method is by keeping constant the pAg of a liquid phase in which silver halide is produced. This method is also known as a controlled double jet method and produces a silver halide emulsion of grains having a regular crystal form and an approximately equal grain size.

A mixture of two or more separately prepared silver halide emulsions may also be used.

During the formation or physical ripening of silver halide grains, there may be copresent an additional salt such as cadmium salts, zinc salts, lead salts, thallium salts, iridium salts and complex salts, rhodium salts and complex salts, iron salts and complex salts. These salts may be added in more or less amounts depending on the intended light-sensitive material.

Removal of soluble salts from the emulsion after precipitation or physical ripening may be carried out by noodle rinsing methods requiring gelation of gelatin or flocculation methods using inorganic salts, anionic surface-active agents, anionic polymers (such as polystyrene sulfonate), and gelatin derivatives (such as acylated gelatins and carbamoylated gelatins).

For the silver halide emulsion of the present invention, reduction sensitization may be further combined with the above-mentioned gold-sulfur sensitization. The reduction sensitization uses a reducing material such as stannous salts, amines, hydrazine derivatives, formamidine sulfinic acid, and silane compounds.

As a binder or protective colloid used in the photographic emulsion of the present invention, gelatin is advantageously used and described so throughout the disclosure. However, other hydrophilic colloids can be used as well, for example, proteins (e.g., gelatin derivatives, graft polymers between gelatin and other high polymers, albumin, casein); sugar derivatives such as cellulose derivatives (e.g., carboxymethylcellulose, cellulose sulfate, hydroxyethylcellulose), sodium alginate, starch derivatives, etc.; and various synthetic hydrophilic substances such as homopolymers or copolymers (e.g., polyvinyl alcohol, partially acetallized polyvinyl alcohol, poly-N-vinylpyrrolidone, polyacrylic acid, polymethacrylic acid, polyacrylamide, polyvinyl imidazole, and polyvinyl pyrazole). More preferably, gelatin is used in combination with polyacrylamide or dextran. The ratio of polyacrylamide and/or dextran to gelatin preferably ranges from 1:10 to 3:10 by weight.

The photographic emulsions of the present invention may contain various compounds for the purposes of preventing fog and stabilizing photographic performance during preparation, shelf storage, and photographic processing of light-sensitive materials. Typical are compounds known as anti-foggants or stabilizers, for example, azoles such as benzothiazolium salts, nitroindazoles, triazoles, benzotriazoles, benzimidazoles (inter alia, nitro- or halo-substituted), etc.; heterocyclic mercapto compounds such as mercaptothiazoles, mercaptobenzothiazoles, mercaptobenzimidazoles, mercaptothiadiazoles, mercaptotetrazoles (inter alia, 1-phenyl-5-mercaptotetrazole), mercaptopyrimidines, etc.; similar heterocyclic mercapto compounds having a water-soluble group such as carboxyl and sulfone groups; thioketo compounds suh as oxazolinethion; azaindenes such as tetrazaindenes, especially 4-hydroxy substituted (1,3,3a,7)-tetrazaindenes; benzenthiosulfonic acids, benzenesulfinic acids, etc. For further detail, reference is made to E. J. Birr, Stabilization of Photographic Silver Halide Emulsions, Focal Press, 1974.

In making a photographic silver halide light-sensitive material using the silver halide emulsion prepared according to the present invention, there may be used conventional agents and elements which are not particularly limited and include color couplers, binders, hardners, matting agents, surface-active agents, anti-fading agents, sensitizing dyes, dyes, polymer latexes, and supports. For further detail, reference is made to Research Disclosure, Vol. 176 (December 1978), pages 21–31.

Dyes may be used in the practice of the present invention. The useful dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes among them are cyanine, merocyanine, and complex merocyanine dyes. For these dyes, any nuclei generally utilized for cyanine dyes can be applied as basic heterocyclic ring nuclei. For example, applicable are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; and nuclei of the foregoing nuclei having cycloaliphatic hydrocarbon rings fused thereto and nuclei of the foregoing nuclei having aromatic hydrocarbon rings fused thereto, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

For the merocyanine and complex merocyanine dyes, 5- or 6-membered heterocyclic nuclei are applicable as a nucleus having a ketomethylene structure, for example, a pyrazolin-5-one nucleus, thiohydantoin nucleus, 2-thiooxazolidine-2,4-dione nucleus, thiazolidine-2,4-dione nucleus, rhodanine nucleus, and thiobarbituric acid nucleus.

Illustrative examples are the compounds disclosed in Research Disclosure, December 1978, Item 17,643, page 23, IV and those described in the literature cited therein.

The following methine dyes are some illustrative, but nonlimiting examples of the useful dyes.

D-1

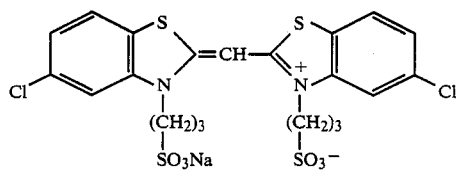

D-2

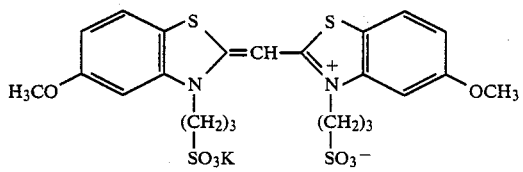

D-3

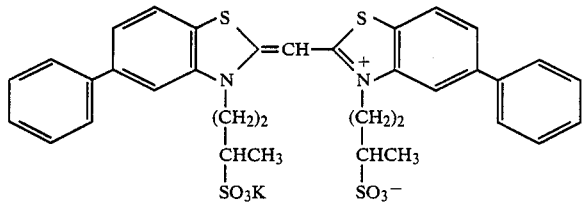

D-4

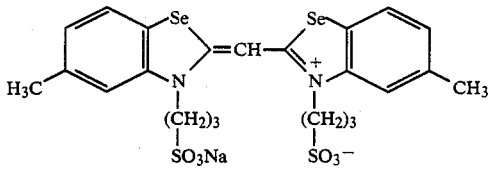

D-5

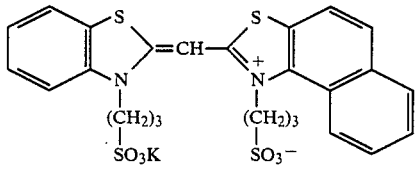

D-6

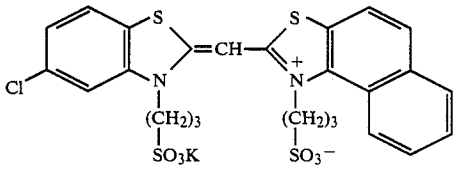

-continued
D-7
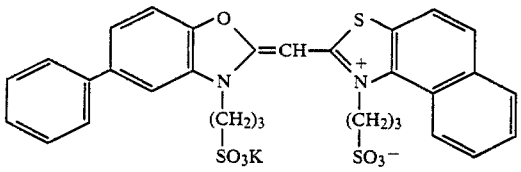
D-8
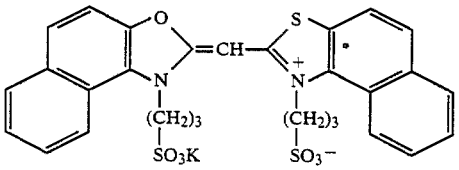
D-9
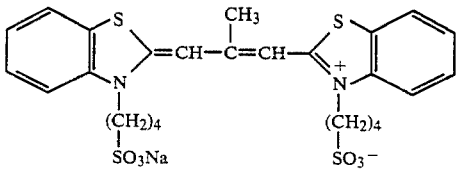
D-10
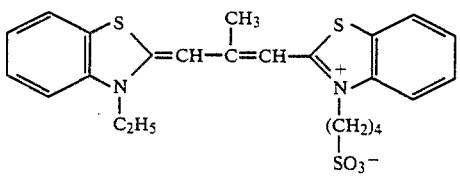
D-11
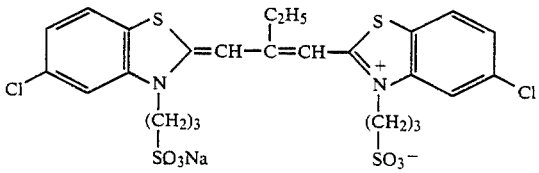
D-12
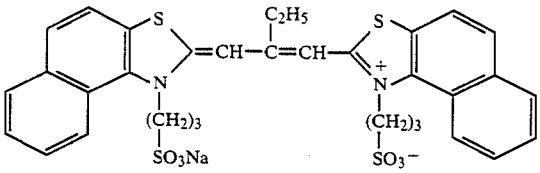
D-13
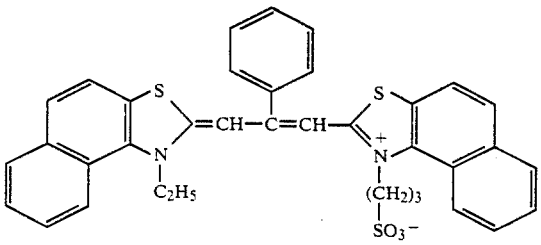
D-14
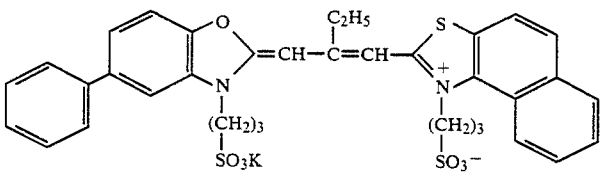

-continued
D-15
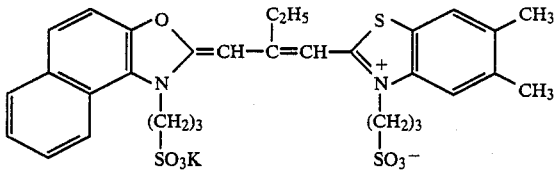
D-16
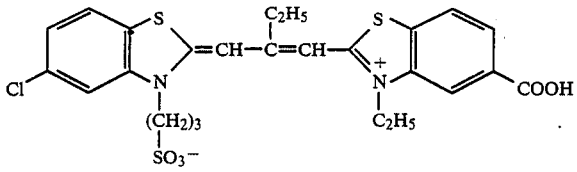
D-17
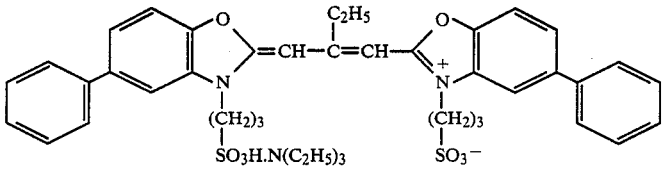
D-18
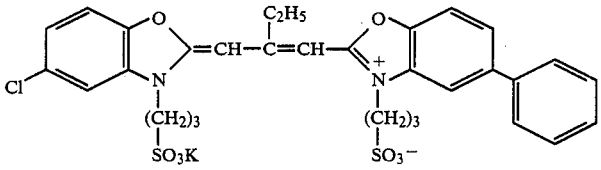
D-19
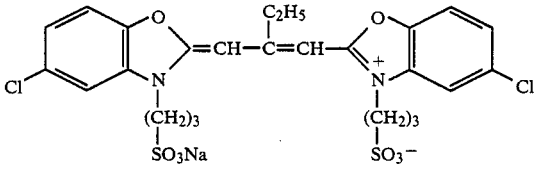
D-20
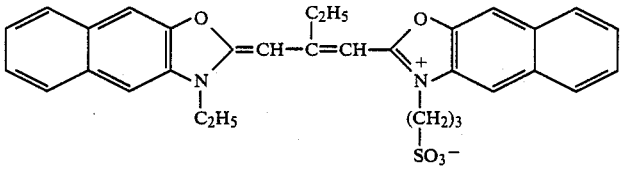
D-21
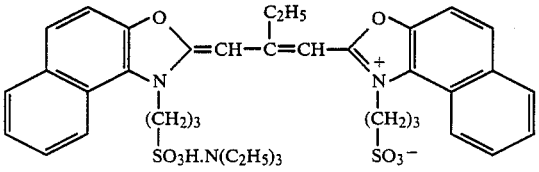
D-22
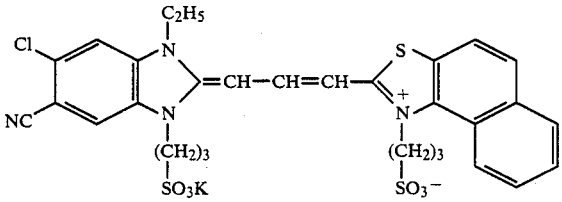

-continued
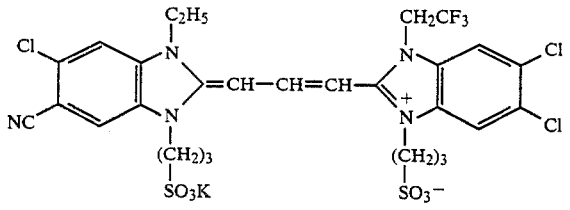
D-23
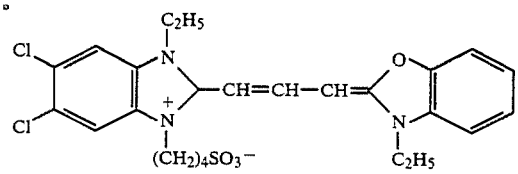
D-24
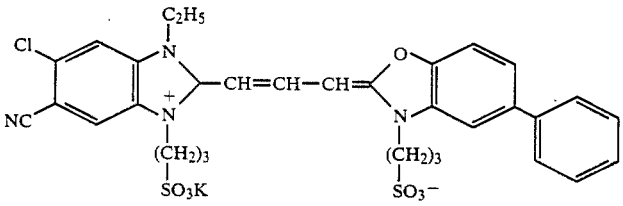
D-25
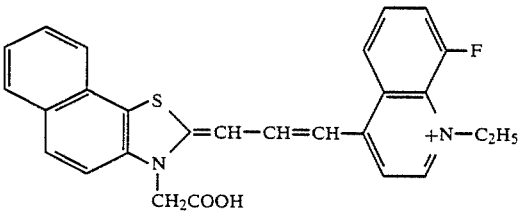
D-26
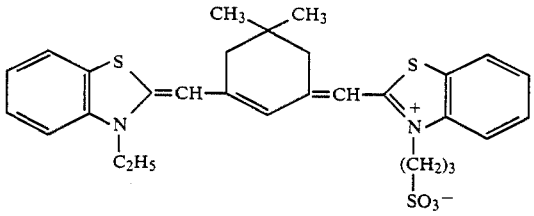
D-27
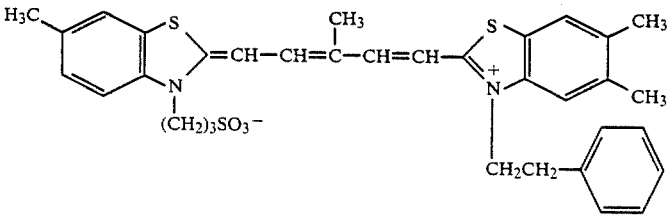
D-28
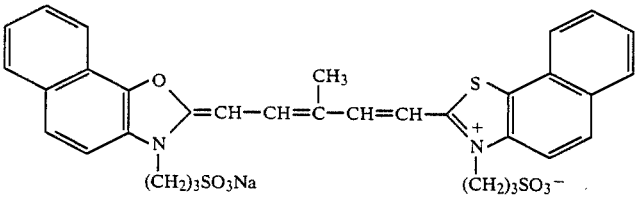
D-29

-continued
D-30
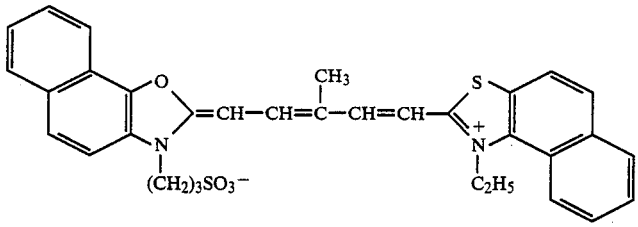
D-31
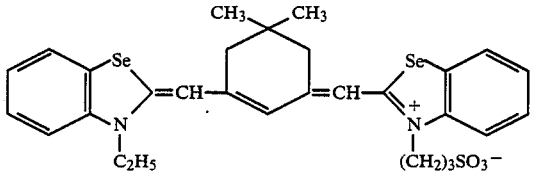
D-32
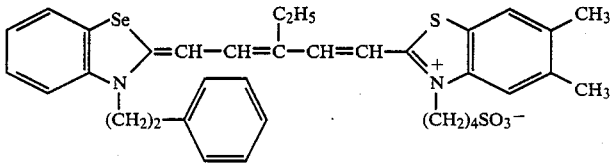
D-33
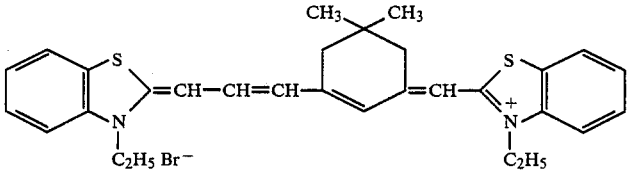
D-34
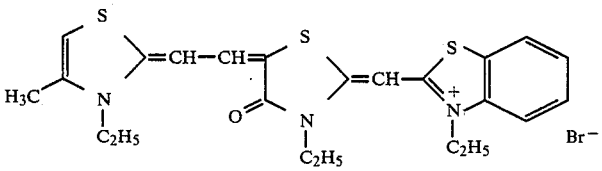
D-35
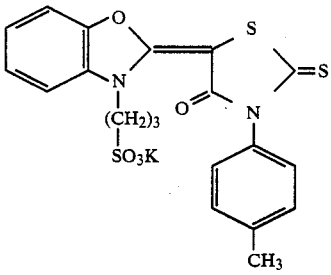
D-36
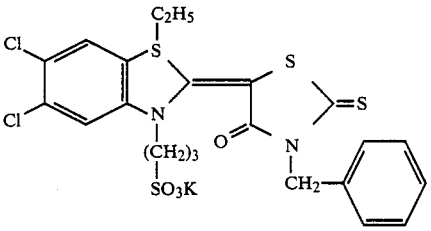
D-37
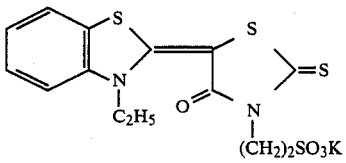

-continued
D-38
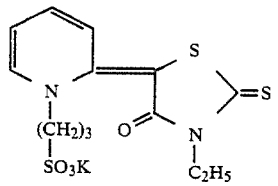
D-39
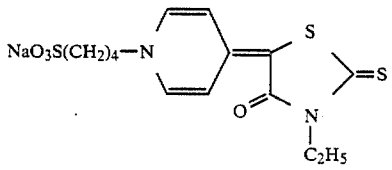
D-40
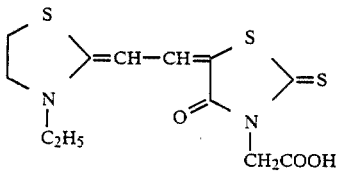
D-41
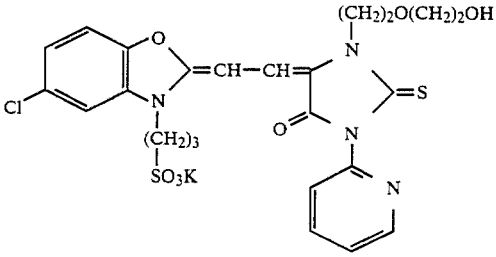
D-42
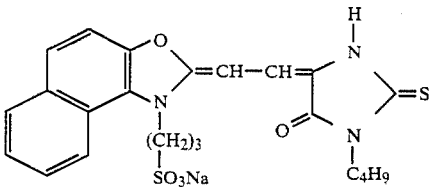
D-43
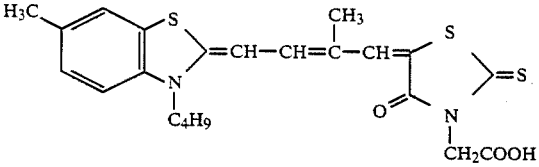
D-44
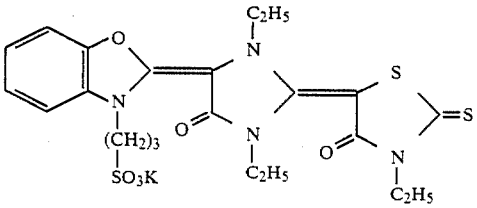
D-45
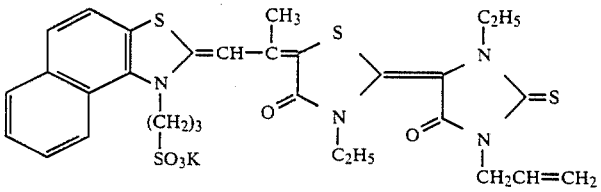

-continued

D-46

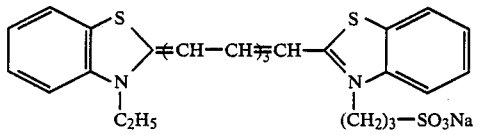

D-47

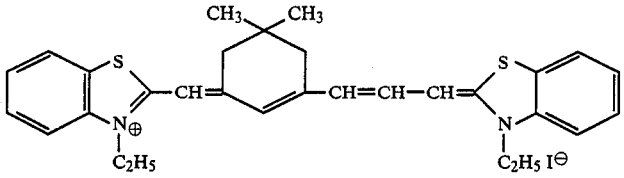

D-48

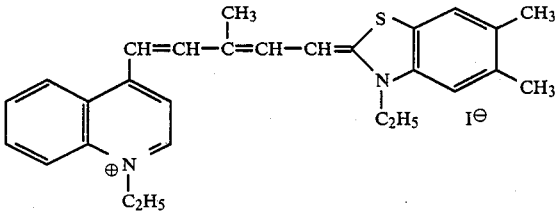

The photographic light-sensitive materials having incorporated the silver halide emulsion of the present invention include various color and black-and-white light-sensitive materials. Illustrative are photographic color negative films (such as still and motion picture films), color reversal films (such as slide and motion picture films, sometimes applied without coupler), color photographic paper, color positive films (such as motion picture films), color reversal photographic paper, heat-developable color light-sensitive materials, color light-sensitive materials adapted for silver dye bleach process, photo-mechanical processing photographic light-sensitive materials (such as lithographic and scanner films), photographic X-ray-sensitive materials (such as those for direct or indirect medical and industrial uses), photographic black-and-white negative films, black-and-white photographic films, microphotographic light-sensitive materials (such as COM and microfilms), color diffusion transfer reversal (DTR) light-sensitive materials, silver salt diffusion transfer light-sensitive materials, and print-out light-sensitive materials. Most preferred light-sensitive materials are those in which shelf stability is an important factor, for example, high sensitivity photographic materials such as color negative films, color reversal films, X-ray-sensitive materials, black-and-white negative films, and diffusion transfer light-sensitive materials. Best results are obtained with high sensitivity photographic materials using a color sensitized, plate-shaped silver halide emulsion, particularly with X-ray-sensitive materials.

Since at least 80% of the gold sensitizer used can be present in the silver halide grain phase of a silver halide emulsion while minimizing the amount of the gold sensitizer remaining in the binder phase, the present invention provides a gold-sensitized silver halide emulsion substantially of surface latent image type having excellent shelf stability and high sensitivity as well as a photographic silver halide light-sensitive material using the same.

EXAMPLES

In order that those skilled in the art will better understand how the present invention may be practiced, the following examples are given by way of illustration and not by way of limitation.

EXAMPLE 1

With vigorous stirring, ammonia was added to an aqueous gelatin solution containing potassium iodide and potassium bromide kept at 75° C. An aqueous solution of silver nitrate and an aqueous solution containing potassium iodide and potassium bromide were concurrently added to the ammoniated solution, obtaining a twin silver iodobromide emulsion having 8 mol% of iodine and an average grain size of about 1.2 μm.

The emulsion was water washed and desalted by flocculation in a conventional manner and then adjusted to pH 6.5 and pAg8.9. The emulsion was heated to a temperature of 60° C., sequentially combined with 4.5 mg of sodium thiosulfate, 2.1 mg of chloroauric acid, and 68 mg of potassium thiocyanate per mol of the silver halide, and allowed to stand for 35 minutes for ripening purposes.

The emulsion was divided into two portions. One emulsion was combined with a coupler, a stabilizer, a gelatin hardener, and a coating aid as shown below without further processing, and then applied to a cellulose acetate film support followed by drying.

The other emulsion was solidified by cooling to a temperature of 15° C. The solid was comminuted, washed with flowing water containing 0.01% of potassium thiocyanate at 15° C. for 10 minutes, and then melted again at 40° C. The emulsion was readjusted for pH and pAg and then applied and dried in the same manner as above.

Stabilizer: 4-hydroxy-6-methyl-1,3,3a,7-tetrazaindene
Coupler: 1-(2,4,6-trichlorophenyl)-3-[3-(2,4-di-tert.-amylphenoxy)-acetamide]benzamide-5-pyrazolone
Gelatin hardener: sodium 2,4-dichloro-6-hydroxy-s-triazine
Coating aid: sodium dodecylbenzenesulfonate The resulting samples were exposed to light through an optical wedge for 1/100 second and then subjected to the following color development.

| Development steps | | |
|---|---|---|
| Step | Time | |
| 1. Color development | 2'45" | (38° C.) |
| 2. Bleaching | 6'30" | |
| 3. Washing | 3'15" | |
| 4. Fixing | 6'30" | |
| 5. Washing | 3'15" | |
| 6. Stabilizing | 3'15" | |

The processing solutions used in these steps had the following compositions.

| Color Developer | |
|---|---|
| Sodium nitrilotriacetate | 1.0 gram |
| Sodium sulfite | 4.0 grams |
| Sodium carbonate | 30.0 grams |
| Potassium bromide | 1.4 grams |
| Hydroxylamine sulfuric acid | 2.4 grams |
| 4-(N-ethyl-N-β-hydroxyethylamino)-2-methyl-aniline sulfuric acid | 4.5 grams |
| Water | totaling to 1 liter |
| Bleaching solution: | |
| Ammonium bromide | 160.0 grams |
| Aqueous ammonia (28%) | 25.0 ml |
| Ethylenediamine tetraacetic acid sodium iron salt | 130 grams |
| Glacial acetic acid | 14 ml |
| Water | totaling to 1 liter |
| Fixing solution: | |
| Sodium tetrapolyphosphate | 2.0 grams |
| Sodium sulfite | 4.0 grams |
| Ammonium thiosulfate (70%) | 175.0 ml |
| Sodium disulfite | 4.6 grams |
| Water | totaling to 1 liter |
| Stabilizing solution: | |
| Formalin | 8.0 ml |
| Water | totaling to 1 liter |

Additionally, the coated samples prepared as above, but not exposed to light were stored in an atmosphere having a temperature of 45° C. and a relative humidity (RH) of 80% for three days before they were similarly exposed to light and developed.

The results are shown in Table 1.

Relative sensitivity (RS) is a relative value given by the inverse of an exposure required to achieve an optical density corresponding to a fog value of +0.2, provided that sample No. 1 has a relative sensitivity of 100 immediately after coating.

The partition coefficient of gold between the silver halide grain and gelatin phases of each emulsion was determined by centrifugally separating the emulsion at 40° C. into the silver halide (AgX) grain solid phase and the gelatin liquid phase, dissolving a predetermined amount of each phase in an aqueous solution of 10% thiourea, and conducting quantitative analysis of gold using a Zeeman atomic absorption photometer. The amount of chloroauric acid per mol of the silver halide was calculated from the measurements and shown in Table 1.

As seen from Table 1, the shelf stability of the coated sample was improved by removing a substantial portion of the gold sensitizer from the gelatin phase.

EXAMPLE 2

With vigorous stirring, 3,6-dithia-1,8-octanediol was added to an aqueous gelatin solution at 60° C. An aqueous solution of silver nitrate and an aqueous solution containing potassium iodide and potassium bromide were concurrently added to the gelatin solution while keeping the pAg at 8.1. There was obtained a monodispersed silver iodobromide emulsion having 3 mol% iodine and an average grain size of about 0.5 μm and containing a major proportion of tetradecahedral grains.

The emulsion was water washed and desalted by flocculation in a conventional manner and then adjusted to pH 6.5 and pAg 8.7. The emulsion was combined with 6.2 mg of sodium thiosulfate, 4.5 mg of chloroauric acid, 80 mg of potassium thiocyanate, and 1.8 mg of sodium benzenthiosulfonate per mol of the silver halide, and allowed to stand at 65° C. for 40 minutes for ripening purposes.

The emulsion was cooled to 40° C. and divided into three portions designated emulsions A, B, and C. Emulsion A was agitated for 10 minutes without further processing. Emulsion B was combined with 4.5 grams of an ion-exchange resin (trade name, Dowex 1×8 from Dow Chemicals) per 500 grams of the emulsion, and then agitated for 10 minutes. Emulsion C was combined with 5 grams of an active carbon per 500 grams of the emulsion, and then agitated for 10 minutes. Emulsions B and C were filtered three times through a microfilter to remove the ion-exchange resin and active carbon from the silver halide emulsions, respectively, readjusted for pH and pAg, and combined with an equal amount (0.72 grams) of 4-hydroxy-6-methyl-(1,3,3a,7)-tetrazaindene.

To each of emulsions A, B, and C were added sodium dodecylbenzenesulfonate (coating aid) and sodium 2,4-dichloro-6-hydroxy-s-triazine (gelatin hardener). The emulsions were applied to cellulose acetate film supports and dried. The resulting coated samples were exposed to light through an optical wedge, developed with Kodak's Formulation-D19 developer at 20° C. for 10 minutes, stopped and fixed.

Additionally, the coated samples prepared as above, but not exposed to light were stored in an atmosphere having a temperature of 50° C. and a relative humidity (RH) of 80% for three days before they were similarly exposed to light and developed.

Quantitative analysis was conducted on the amounts of gold in the the silver halide grain and gelatin phases of each of emulsions A, B, and C as in Example 1.

The results are shown in Table 2.

Relative sensitivity (RS) as defined in Example 1 is based on the relative sensitivity of 100 for emulsion A immediately after coating.

TABLE 1

| Sample | Immediately after coating | | 3 day storage @ 45° C., 80% RH | | Chloroauric acid in | | |
|---|---|---|---|---|---|---|---|
| | | | | | AgX | Gelatin | |
| No. | Fog | RS | Fog | RS | (A) | (B) | A/A + B |
| 1* | 0.10 | 100 | 0.07 | 80 | 1.4 mg | 0.7 mg | 67% |
| 2 | 0.10 | 100 | 0.09 | 95 | 1.4 mg | 0.1 mg | 93% |

*comparison

TABLE 2

| Emulsion in sample | Relative sensitivity: Immediately after coating | Relative sensitivity: 3 day storage @ 50° C., 85% RH | Chloroauric acid in: AgX (A) | Chloroauric acid in: Gelatin (B) | Chloroauric acid in: A/A + B |
|---|---|---|---|---|---|
| A* | 100 | 65 | 3.2 mg | 1.3 mg | 71% |
| B | 100 | 95 | 3.2 mg | 0.2 mg | 94% |
| C | 100 | 80 | 3.2 mg | 0.7 mg | 82% |

*comparison

As seen from Table 2, the shelf stability of the coated sample was improved by removing a substantial portion of the unreacted gold sensitizer from the gelatin phase.

EXAMPLE 3

With stirring, an aqueous solution of silver nitrate and an aqueous solution containing potassium iodide and potassium bromide were added to an aqueous solution of potassium bromide and gelatin kept at 70° C. by the double jet method. At the end of addition, soluble salts were removed by precipitation and additional gelatin was dissolved in the solution which was adjusted to pH 6.8. The resulting plate silver halide grains had an average grain diameter of 1.9 μm, an average thickness of 0.14 μm, an average diameter/thickness ratio of 13.6, and a silver iodide content of 3 mol%. The emulsion had a pAg of 8.95 at 40° C.

The emulsion was subjected to optimum gold-sulfur sensitization at 62° C. using sodium thiosulfate, chloroauric acid, and potassium thiocyanate.

The emulsion was cooled to 40° C. and divided into two portions. One emulsion designated emulsion D was agitated for 10 minutes without further processing. The other emulsion designated emulsion E was combined with 4 grams of active carbon per kg of the emulsion, agitated for 10 minutes, and filtered through a microfilter to remove the active carbon.

Each of the emulsions was subjected to green sensitization by adding 500 mg of sodium salt of anhydro-5,5'-dichloro-9-ethyl-3,3'-di(3-sulfopropyl)oxacarbocyanine hydroxide and 200 mg of potassium iodide per mol of silver.

Thereafter, 4-hydroxy-6-methyl-1,3,3a,7-tetrazaindene stabilizer, sodium p-dodecylbenzenesulfonate coating aid, and sodium 2,4-dichloro-6-hydroxy-s-triazine hardener were added to the emulsion. The emulsion was coated to a polyethylene terephthalate (PET) film support along with a surface protective film by a coextrusion technique.

The coated samples were aged for three days in an atmosphere X at a temperature of 25° C. and a relative humidity of 60% and an atmosphere Y at a temperature of 50° C. and a relative humidity of 80%. They were exposed to light through a yellow filter and an optical wedge, and developed with a developer Hi-Rendol (trade name, manufactured by Fuji Photo-Film K.K.) at 20° C. for 4 minutes, followed by fixing, washing and drying.

For evaluation, relative sensitivity was calculated from an exposure required to accomplish a degree of blackening corresponding to a fog value of +1.0. The relative sensitivity of the emulsion D sample aged in atmosphere Y was reduced to 70% of that of the same aged in atmosphere X. The relative sensitivity of the emulsion E sample aged in atmosphere Y was reduced to 95% of that of the same aged in atmosphere X, indicating an improvement in shelf stability under high-temperature, high-humidity conditions.

The samples coated with emulsions D and E were respectively washed with a 0.01% hypo solution at 20° C. for 10 minutes.

The amounts of silver and gold were quantitatively determined both before and after washing by fluorescent X-ray analysis for Ag and Zeeman atomic absorption spectroscopy for Au. No change was observed in the amount of Ag coated whereas the amount of Au is reduced by washing to 65% for emulsion D and 95% for emulsion E. Since the gold in the gelatin phase is taken away by hypo bath washing, these values are considered to correspond to the proportion of gold contained in the silver halide grain phase of emulsions D and E. It was found that as large as 95% of the entire gold used in emulsion E had been contained in the silver halide grain phase.

The data of Examples 1–3 indicate that the coated samples aged under high-temperature, high-humidity conditions maintain improved shelf stability when the proportion of gold contained in the silver halide grain phase is 80% or higher, and more improved when 90% or higher.

EXAMPLE 4

Spherical grains of silver iodobromide (silver iodide 2.4 mol%) having an average grain size of 1.1 μm were formed in the presence of ammonia by the double jet method. The emulsion was subjected to gold-sulfur sensitization at 65° C. using chloroauric acid, potassium thiocyanate, and sodium thiosulfate.

The emulsion was cooled to 40° C. and divided into two portions. One emulsion designated emulsion F was agitated for 10 minutes without further processing. The other emulsion designated emulsion G was combined with 4 grams of active carbon per kg of the emulsion, agitated for 10 minutes, and then passed through a microfilter to remove the active carbon.

To each of the emulsions were added a green sensitizing dye, stabilizer, coating aid, and hardener as used in Example 3.

The amount of the gold sensitizer used with the spherical grains was 0.8 times that used with the plate grain emulsions of Example 3.

The distribution of gold between the silver halide grain and gelatin phases was determined by the same procedure as used in Example 1, finding that the proportion of gold contained in the silver halide grain phase was 70% for emulsion F and 95% for emulsion G.

The plate silver halide grain emulsion of Example 3 and the spherical silver halide grain emulsion of this Example were applied to a PET support as lower and upper coatings, respectively, in a combination as shown in Table 3. They were coated and dried at the same time as a gelatin surface protective layer.

The amounts of silver contained in the lower and upper coatings were 1.5 and 0.5 gram/m$^2$, respectively.

The coated samples were aged in atmosphers X and Y as defined in Example 3, and thereafter subjected to exposure, development, fixing, washing, and drying as in Example 3. Table 3 also reports the relative sensitivity calculated from an exposure required to accomplish a degree of blackening corresponding to a fog value of +1.0, provided that the relative sensitivity of sample No. 10 aged in atmosphere X was 100.

Table 3 also reports the amount of Au in the coated sample which was washed with 0.01% hypo solution as in Example 3. As seen from Table 3, the double-coated light-sensitive materials made in this example exhibit fairly improved shelf stabilty when one of the emulsions involved is an emulsion falling within the scope of the present invention (see sample No. 11), and significantly improved shelf stability when at least 80% of the entire amount of gold is contained in the silver halide grain phase (see sample No. 12). Best results are obtained when both the emulsions are ones falling within the scope of the present invention (see sample No. 13).

TABLE 3

| Sample No. | Emulsion in Lower coating | Emulsion in Upper coating | Relative sensitivity in X | Relative sensitivity in Y | Residual Au* |
|---|---|---|---|---|---|
| 10 | D | F | 100 | 65 | 66% |
| 11 | D | G | 100 | 80 | 70% |
| 12 | E | F | 100 | 92 | 89% |
| 13 | E | G | 100 | 95 | 95% |

*Residual Au is the amount of Au remaining after hypo solution washing divided by the amount of Au before washing.
Underlined emulsions are outside the scope of the invention.

EXAMPLE 5

With stirring, 150 ml of a 2.00M silver nitrate solution and 150 ml of a 2.00M potassium bromide solution were added to 1 liter of a 0.8 wt% gelatin solution containing 0.08M of potassium bromide by the double jet method. The gelatin solution was kept at 30° C. during the process. At the end of addition, the mixture was heated to a temperature of 75° C. and 30 grams of gelatin was added thereto.

At the end of the first stage addition, 90 ml of a 1.0M silver nitrate solution was added. At the end of addition, the solution was allowed to stand for ripening. The thus formed grains, referred to as seeds hereinafter, were washed by flocculation in a conventional manner, and the solution was adjusted to pH 5.0 and pAg 7.5 at 40° C.

One tenth of the seeds were dissolved in 1 liter of a solution containing 3% by weight of gelatin, which was maintained at a temperature of 75° C. and a pBr of 2.55. Thereafter, 150 grams of silver nitrate was added in an accelerating flow rate (the flow rate at the completion is 19 times that at the initial) over 60 minutes while maintaining the pBr at 2.55.

Thereafter, the emulsion was cooled to 35° C., washed by flocculation in a conventional manner, and adjusted to pH 6.5 and pAg 8.6 at 40° C. There was obtained a mono-dispersed emulsion wherein 80% of the plate grains were occupied by hexagonal plate grains having a coefficient of variation of 18%. The grains had an average diameter of the projected area equivalent circle of 1.8 μm and an average thickness of 0.16 μm.

The emulsion was subjected to optimum gold and sulfur sensitization at 58° C. using sodium thiosulfate, chloroauric acid, and potassium thiocyanate.

The emulsion was cooled to a temperature of 40° C. and divided into two portions. One emulsion designated emulsion H was agitated for 10 minutes without further processing. The other emulsion designated emulsion I was combined with 3 grams of active carbon per kg of the emulsion, agitated for 10 minutes, and then passed through a microfilter to remove the active carbon.

To each of the emulsions were added a sensitizing dye, potassium iodide, stabilizer, coating aid, and hardener as used in Example 3. The emulsion was applied to a PET support along with a surface protective layer by a coextrusion technique.

The coated samples were aged for three days in an atmosphere X at a temperature of 25° C. and a relative humidity of 60% and an atmosphere Y at a temperature of 50° C. and a relative humidity of 80%. They were exposed to light through a yellow filter and an optical wedge, and developed with a developer Hi-Rendol (trade name, manufactured by Fuji Photo-Film K.K.) at 20° c. for 4 minutes, followed by fixing, washing and drying.

For evaluation, relative sensitivity was calculated from an exposure required to accomplish a degree of blackening corresponding to a fog value of +1.0. The relative sensitivity of the emulsion H sample aged in atmosphere Y was reduced to 75% of that of the same aged in atmosphere X. The relative sensitivity of the emulsion I sample aged in atmosphere Y was reduced to only 95% of that of the same aged in atmosphere X, indicating an improvement in shelf stability under high-temperature, high-humidity conditions.

The samples coated with emulsions H and I were respectively washed with an aqueous 0.1% potassium thiocyanate solution at 20° C. for 10 minutes.

The amounts of silver and gold were quantitatively determined both before and after washing by fluorescent X-ray analysis for Ag and Zeeman atomic absorption spectroscopy for Au. No change was observed in the amount of Ag coated whereas the amount of Au is reduced by washing to 70% for emulsion H and 92% for emulsion I. Since the gold in the gelatin phase is taken away by potassium thiocyanate solution washing, these values are considered to correspond to the proportion of gold contained in the silver halide grain phase of emulsions H and I. It was found that as large as 92% of the entire gold used in emulsion I had been contained in the silver halide grain phase. Emulsion I falling in the scope of the present invention exhibits improved shelf stability as coated in a high-temperature, high-humidity atmosphere.

EXAMPLE 6

Coated samples were prepared by applying emulsions H and I prepared in Example 5 to PET supports by the same procedure as in Example 5 except that the sensitizing dye was replaced by 200 mg of dyes D-9, D-11, D-23, D-28 and D-41.

The coated samples were subjected to the same development as in Example 5 after being aged in atmospheres X and Y in the same manner as in Example 5.

For all the sensitizing dyes, the samples coated with emulsion I experienced a less reduction than those coated with emulsion H with respect to the reduction of the relative sensitivity of the sample aged in atmosphere Y as compared with that in atmosphere X. As in Example 5, the benefits of the present invention are obtained by reducing the proportion or amount of gold remaining in the binder phase.

Although the above examples are directed to only a few of the very many variables which can be utilized in the practice of the present invention, it should be understood that the present invention is directed the preferential distribution of gold sensitizer in the silver halide grain phase of a silver halide emulsion as shown in the description preceding these examples.

I claim:

1. A gold-sensitized silver halide emulsion substantially of surface latent image type comprising silver halide grains, a gold sensitizer, and a binder, at least 80% by weight of the gold sensitizer being present in the silver halide grain phase.

2. The silver halide emulsion of claim 1 wherein at least 90% by weight of the gold sensitizer is present in the silver halide grain phase.

3. The silver halide emulsion of claim 1 wherein at least 93% by weight of the gold sensitizer is present in the silver halide grain phase.

4. The silver halide emulsion of claim 1 wherein the emulsion has been treated with a porous adsorbent or ion-exchange resin to remove the gold sensitizer from the binder phase.

5. The silver halide emulsion of claim 1 wherein the emulsion has been washed to remove the gold sensitizer from the binder phase.

6. The silver halide emulsion of claim 1 wherein the emulsion has been subjected to mechanical separation to remove the gold sensitizer from the binder phase.

7. The silver halide emulsion of claim 1 wherein the emulsion is spectrally sensitized with a dye selected from the group consisting of cyanine, merocyanine, and complex merocyanine dyes.

8. A photographic silver halide light-sensitive material comprising at least one emulsion layer which contains at least one gold-sensitized silver halide emulsion substantially of surface latent image type comprising silver halide grains, a gold sensitizer, and a binder, at least 80% by weight of the gold sensitizer being present in the silver halide grain phase.

9. The photographic material of claim 8 wherein at least 90% by weight of the gold sensitizer is present in the silver halide grain phase.

10. The photographic material of claim 8 wherein at least 93% by weight of the gold sensitizer is present in the silver halide grain phase.

11. The photographic material of claim 8 wherein the emulsion has been treated with a porous adsorbent or ion-exchange resin to remove the gold sensitizer from the binder phase.

12. The photographic material of claim 8 wherein the emulsion has been washed to remove the gold sensitizer from the binder phase.

13. The photographic material of claim 8 wherein the emulsion has been subjected to mechanical separation to remove the gold sensitizer from the binder phase.

14. The photographic material of claim 8 wherein the emulsion is spectrally sensitized with a dye selected from the group consisting of cyanine, merocyanine, and complex merocyanine dyes.

15. A photographic silver halide light-sensitive material comprising at least one layer of a gold-sensitized silver halide emulsion substantially of surface latent image type, at least 80% by weight of the total amount of gold sensitizer contained in said light-sensitive material being present in the silver halide grain phase.

* * * * *